United States Patent [19]

Lecrone

[11] 4,049,171

[45] * Sept. 20, 1977

[54] ADJUSTABLE ROLL SLICING SYSTEM

[76] Inventor: Dale S. Lecrone, 4447 Bonnymede, Jackson, Mich. 49201

[ * ] Notice: The portion of the term of this patent subsequent to Oct. 14, 1992, has been disclaimed.

[21] Appl. No.: 723,919

[22] Filed: Sept. 16, 1976

[51] Int. Cl.[2] ..... B26D 3/28

[52] U.S. Cl. ..... 225/94; 83/4; 83/508.3

[58] Field of Search ..... 83/4, 504, 499, 482, 83/508.1, 508.2, 508.3, 425.4; 225/94, 93

[56] References Cited

U.S. PATENT DOCUMENTS

| | | | |
|---|---|---|---|
| 2,360,653 | 10/1944 | Davidson | 83/504 X |
| 2,803,279 | 8/1957 | Strand | 83/422 X |
| 2,987,089 | 6/1961 | Lecrone | 83/4 |
| 3,112,780 | 12/1963 | Lecrone | 83/4 |
| 3,685,379 | 8/1972 | Frye et al. | 83/499 X |
| 3,911,769 | 10/1975 | Lecrone | 83/4 |
| 3,972,255 | 8/1976 | Irving et al. | 83/4 |

*Primary Examiner*—J. M. Meister
*Attorney, Agent, or Firm*—C. Hercus Just

[57] ABSTRACT

A machine for slicing rolls between the tops and bottoms thereof while arranged in clusters of a predetermined number of separably adjoined rolls by cutting into one side of the rolls in such clusters along but spaced from a longitudinal joint between adjacent rolls in said clusters. The slicing is effected by a plurality of disc type knives supported on the lower ends of vertical spindle shafts supported in a cutter head frame mounted above a conveyor which feeds clusters of rolls to said knives, said spindle shafts being rotatably supported within bearings in a plurality of bearing blocks adjustable between opposite sides of said cutter head frame by coengaging worm and worm gear means operable readily by manually-engageable members supported adjacent the forward end of said cutter head frame. Said bearing blocks also support roll breaking units which are movably supported thereon between operative and inoperative positions and manually-engageable means also positioned adjacent the forward end of said cutter head frame effect movement of said roll breaking units toward the inoperative positions thereof, while spring means urge said units toward the operative positions thereof for coaction with the knives supported by said cutter head frame.

12 Claims, 6 Drawing Figures

ADJUSTABLE ROLL SLICING SYSTEM

BACKGROUND OF THE INVENTION

In certain respects, the present invention comprises an improvement of the roll slicing structure comprising the subject matter of applicant's prior U.S. Pat. No. 3,911,796, issued Oct. 14, 1975 and entitled ROLL SLICING SYSTEM. Said prior patent comprises a plurality of bearing blocks mounted upon transversely extending shafts in a cutter head frame supported above a horizontal conveyor which feeds a plurality of clusters of rolls in succession to rotatable disc knives supported by the bearing blocks. In said machine, as well as in similar prior machines, lateral adjusting of the bearing block is effected manually by moving the bearing blocks along the transversely extending support and guide rods in the cutter head frame and when a desired position for each of said bearing blocks is obtained, more or less by trial and error methods, such adjusted positions are stabilized by employing set screws in the bearing blocks which engage one of the support and guide rods for said blocks.

There also is included in said prior patent of the applicant a plurality of roll-breaking units which are supported respectively by certain of said bearing blocks for the spindle shafts of the disc knives, said units being mounted upon said bearing blocks forwardly of said spindle shafts relative to the direction of feed of said rolls by said conveyor, said breaking units being in longitudinal alignment with said spindle shafts and comprising a pair of angularly disposed, rotatable shafts terminating at the lower ends thereof in blade-like configurations which terminate in a plane substantially immediately above the plane in which the disc knives operate and the same are rotatable in opposite direction to break apart pairs of rolls along the joint between the same above the slice made in each roll by said knives for purposes of providing a clearance for the passage of the spindle shafts of said knives between pairs of rolls incident to said rolls being sliced from end to end. Under circumstances however where it is not desired to have the roll breaking means function in said machine, it is necessary to remove the same from the machine in order to permit only the roll slicing knives to function.

The purpose of the present invention is to provide greater convenience and ease of operation incident to adjusting the position of the roll slicing knives relative to each other and also effect movement of the roll breaking units between operative and inoperative positions in order to eliminate the necessity of removing the same from the machine when it is desired to eliminate the function thereof and employ only the roll slicing knives.

SUMMARY OF THE INVENTION

It is one of the principal objects of the invention to provide in a roll slicing machine, of the type referred to above, means by which the bearing blocks for the roll slicing knives can be moved transversely with respect to the direction of the feed of rolls in the machine and longitudinally upon the support and guide rod extending between opposite sides of the cutter head frame by the employment of a threaded rod which extends transversely between opposite sides of the cutter head frame, in parallelism with the support and guide rods of said frame, and fixed against rotation relative to said frame, and each of said bearing blocks having a worm gear mounted upon said threaded rod and rotatable with respect to each bearing block but is maintained against transverse movement with respect to said bearing blocks, and each bearing block also having a worm engageable with said worm gear and operable by a forwardly extending shaft having manually engageable means such as a hand wheel on the forward ends of each shaft, whereby substantially micromatic adjustment of said bearing blocks and the knives supported thereby may be effected, either while the machine is operating or idle, the manually engageable means which effects such adjustment being positioned in a highly safe location amply remote from the rotatable knives and, after adjustment of said bearing blocks and knives have been individually effected by movement of the same upon the support and guide rods therefor, the shafts for said worms are locked against additional movement.

Another important object of the invention is to provide supplemental bearing blocks pivotally connected to the bearing blocks which support the disc knives and spindle shafts thereof, said supplemental bearing blocks respectively supporting the pairs of rotatable shafts comprising the roll breaking units, and spring means being connected between said supplemental bearing blocks and the bearing blocks which support the same, said spring means being arranged normally to urge the operative ends of the rotatable shafts of the supplemental blocks toward the operative position thereof adjacent the upper surfaces of the disc knives, forwardly thereof, but said machine being provided with manually operable means to move the supplemental blocks in a direction to dispose the operative ends of said rotatable shafts in an inoperative position spaced from the upper surfaces of the disc knives, said machine also including further means to maintain said roll breaking unit in said inoperative positions until further employment thereof is desired in the operation of the machine.

Details of the foregoing objects and of the invention are set forth in the following specification and are described in the accompanying drawings comprising a part thereof.

DETAILED DESCRIPTION

For purposes of simplifying the description and illustration of the present invention, basic details of the roll slicing machine of the type to which the present invention pretains have largely been eliminated, such as the base frame which usually extends to a floor surface, the means which support the endless flexible conveyor with respect to the base frame, bracing means and other related details of the base frame. For purposes of at least briefly illustrating part of the base frame however, side members 10 of such base frame are illustrated fragmentarily in FIGS. 1 and 2. Also, for further description and illustration of certain details included in the cutter head frame 12 of the present invention and particularly those elements which are the same or similar to corresponding elements in applicant's prior U.S. Pat. No. 3,911,769, attention is directed to said patent to supply such additional description and illustration since, in general, the present invention pretains to two principal areas of the roll slicing machine otherwise basically shown in said prior patent of the applicant.

Figure 1:
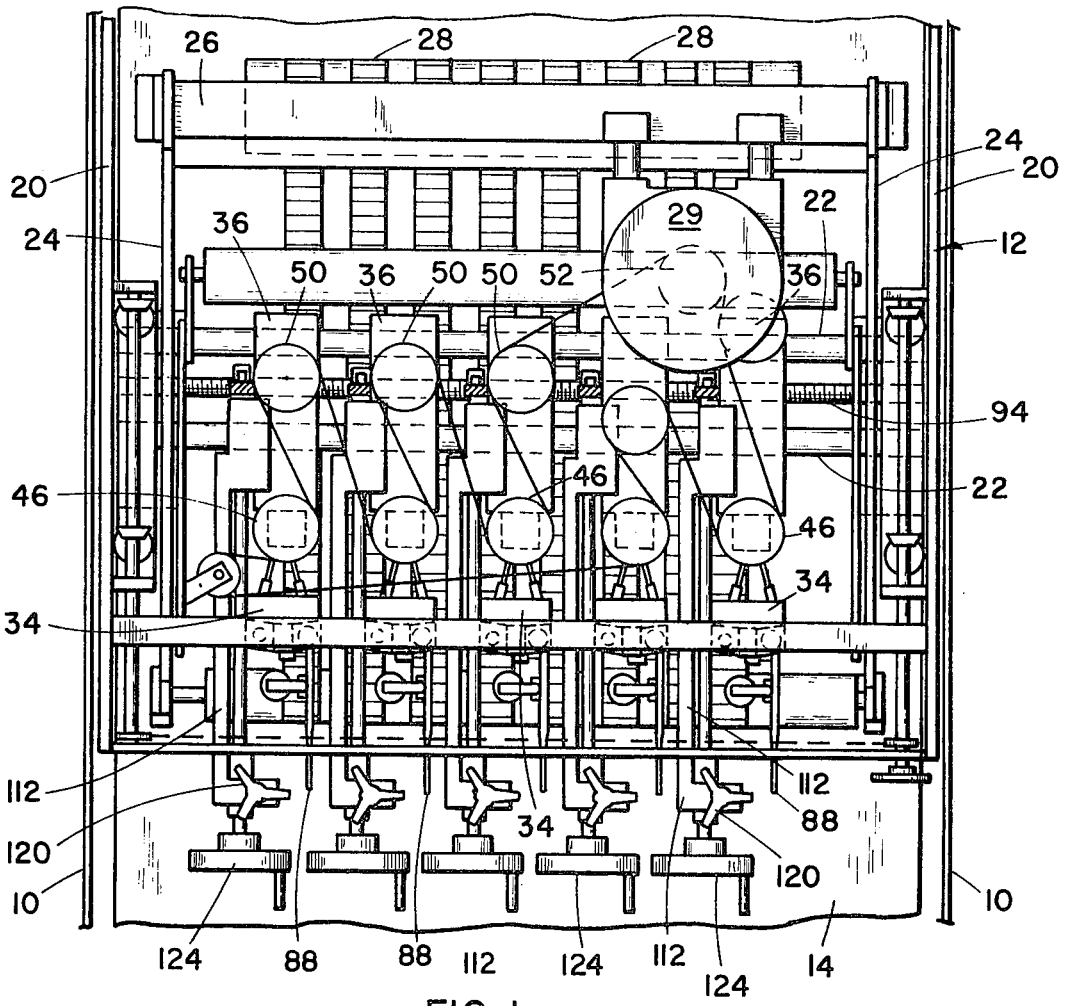
FIG. 1 is a fragmentary plan view of a roll slicing machine embodying the principles of the invention and illustrating primarily the cutter head frame which is mounted above a fragmentarily illustrated portion of a conveyor which feeds clusters of rolls to the knives supported by said cutter head frame.
Figure 2:
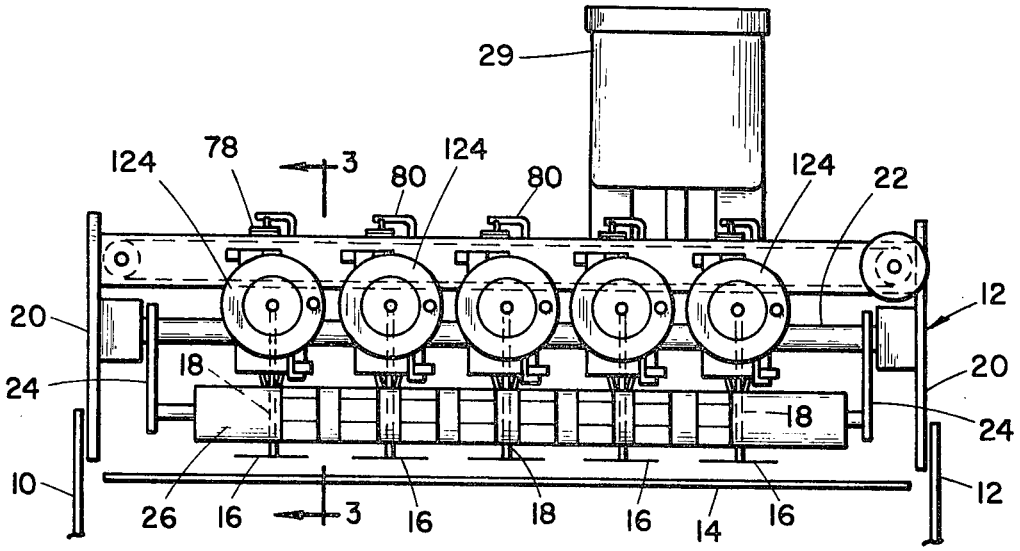
FIG. 2 is a front elevation of the portion of the roll slicing machine which is illustrated in FIG. 1.

Referring to FIGS. 1 and 2, the cutter head frame 12 is suitably supported relative to the side members 10 of the base frame of the machine. Preferably, the cutter head frame is pivotally mounted adjacent one end relative to the base frame 10 in order that the opposite end of the frame may be elevated for purposes of inspecting and affording access to the rotatable disc knives for purposes of exchanging and/or mounting the same within the means that support them and described in detail hereinafter. Also, there is suitably supported immediately beneath the cutter head frame an endless, flexible conveyor 14 upon the upper span of which shown in FIGS. 1 and 2 various kinds and shapes of clusters of rolls are positioned for feeding such clusters to the slicing knives 16 which comprise discs fixed to the lower ends of spindle shafts 18 of the type shown in greater detail in FIG. 3. In FIG. 2 however, it will be seen that the knives 16 are parallel to the upper span of conveyor 14 and are spaced sufficiently above said span in order that the knives will slice the rolls inwardly from one edge of each roll and substantially to the opposite edge thereof, approximately midway between the top and bottom of each roll. It also will be understood that the endless flexible conveyor 14 is supported adjacent opposite ends of the main frame by driving and idler rolls, not shown, in accordance with conventional construction in roll slicing machines of the type to which the invention pretains.

The cutter head frame 12 comprises a pair of platelike side members 20 which are parallel to each other and extend vertically. A plurality of support and guide rods 22 extend between said side members and the opposite ends of said rod are rigidly fixed thereto by various suitable means. The cutter head frame 12 also supports, inwardly from the side members 20 thereof and parallel thereto, a pair of sub-frame members 24, the principal function of which is to support adjacent opposite ends thereof drums 26 around which a plurality of parallel endless flexible frictional belts 28 extend which, as described in greater detail in applicant's aforementioned prior patent engage the upper surfaces of rolls to be sliced and thereby cooperate with the upper span of the main conveyor 14, holding the clusters of rolls substantially stationarily upon the main conveyor 14 while the slicing knives 16 are operating to slice the rolls of the clusters in a manner also illustrated in greater detail in applicant's prior patent referred to above.

The upper portion of the cutter head frame 12 also supports an electric motor 29 comprising the power means which drives the rotatable shafts with which the present invention is concerned. These shafts comprise the spindle shaft 18 which support the disc knives 16 and a pair of rotatable shafts 30, see FIG. 3, which comprise part of roll breaking units 32, details of which are best shown in FIGS. 3 and 4.

Figure 3:
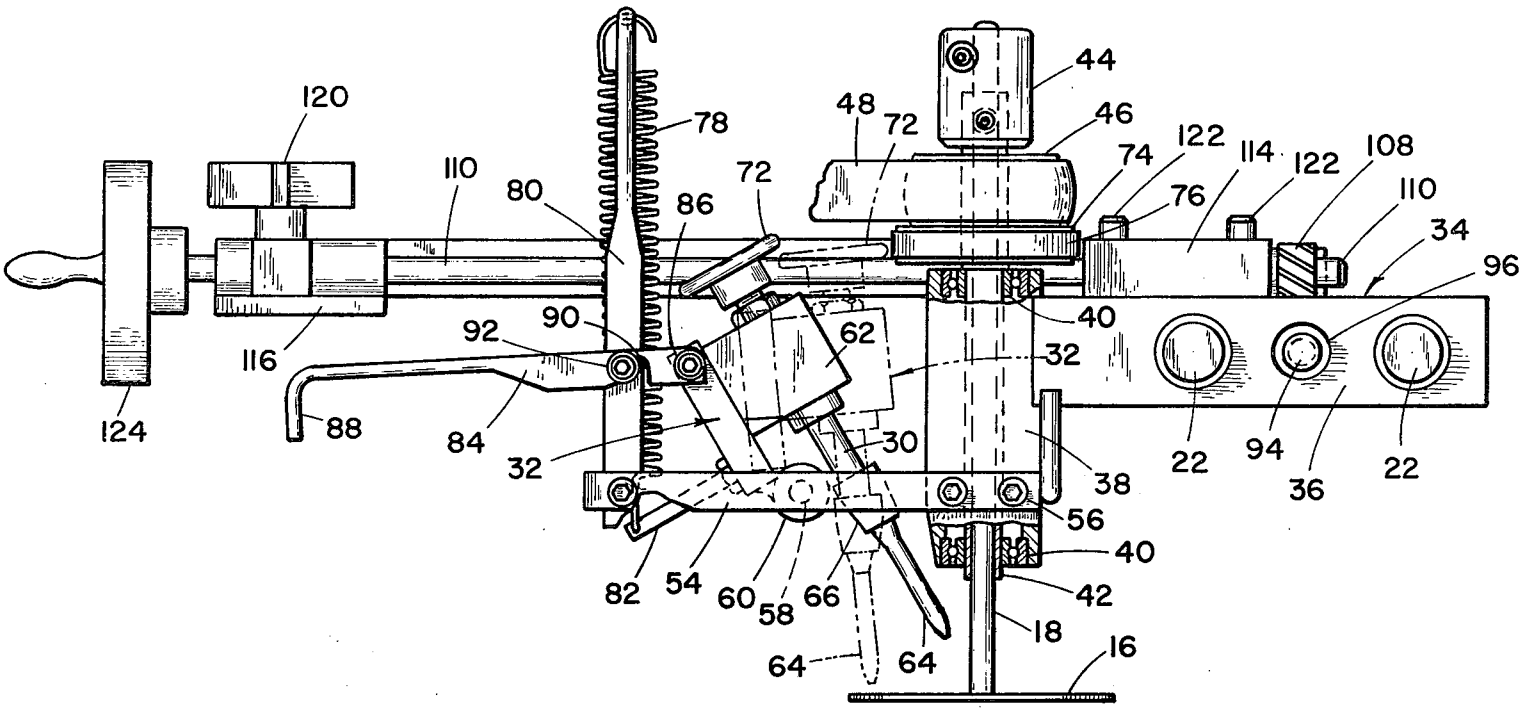
FIG. 3 is a substantially enlarged side elevation of one of the bearing blocks which support the rotatable disc knives and roll breaking units substantially as shown on the line 3—3 of FIG. 2, said figure also illustrating the inoperative position of the roll breaking unit in full lines and, in phantom, showing said roll breaking unit in operative position, this figure also showing the manual engageable means for moving the roll breaking unit to the inoperative position and maintaining it therein.
Figure 4:
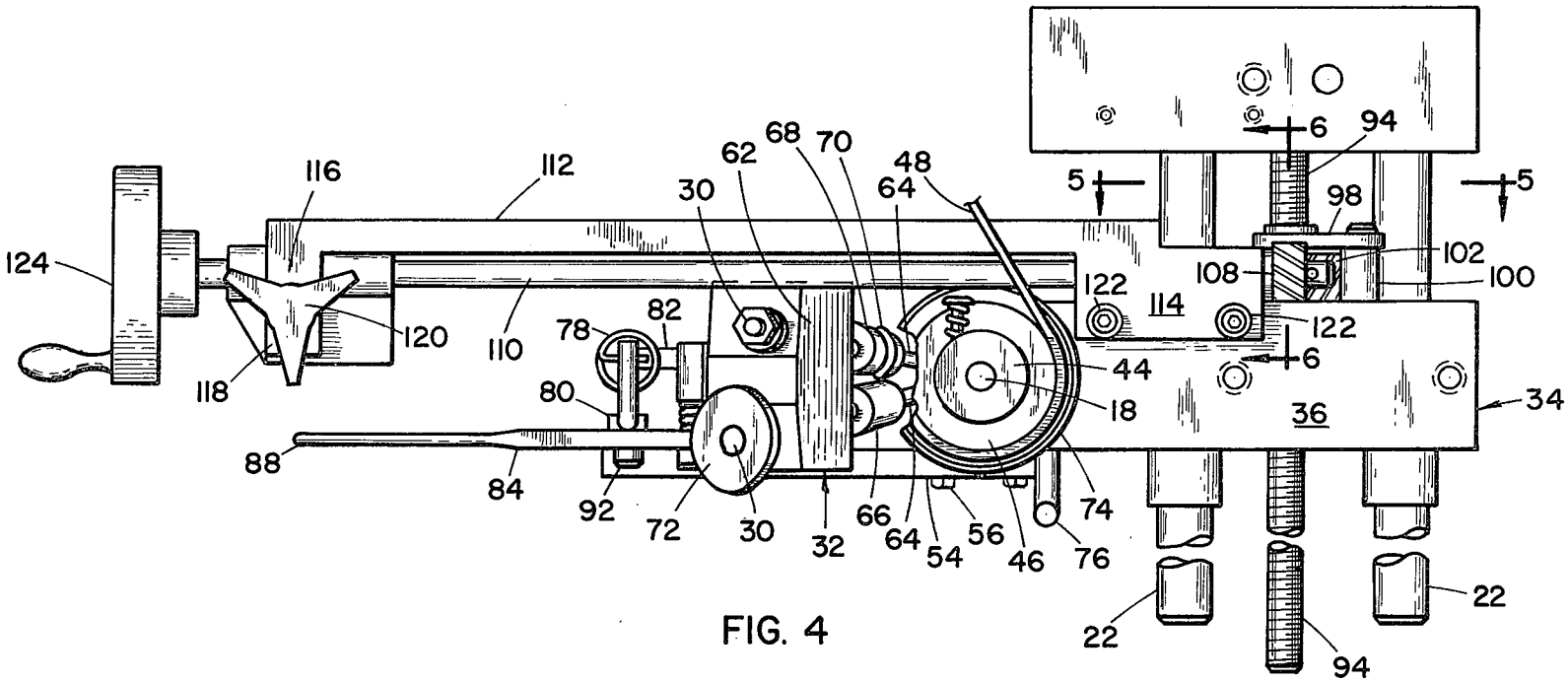
FIG. 4 is a top plan view of the unit and mechanism illustrated in FIG. 3 and fragmentarily showing portions of the support and guide rod for the cutter head frame and a portion of the drive means which operates the spindle shaft of each disc knife.

The cutter head frame 12 supports upon a pair of the support and guide rods 22 a plurality of bearing blocks 34 as can best be seen from FIGS. 3 and 4, said bearing blocks have a rectangular, horizontal portion 36 which contains bearing holes through which the guide rods 22 extend and upon which the bearing blocks 34 are slideably mounted for adjustable transverse positioning between the opposite sides of the cutter head frame 12. The bearing blocks 34 also include a forward, vertically extending portion 38, best shown in FIG. 3, through which a vertical bearing opening is formed to support anti-friction bearings 40 adjacent opposite ends thereof for engagement with a sleeve 42 which receives the major length of the spindle shaft 18 for each of the knives 16, the upper end of the sleeve 42 supporting a chuck 44 by which the upper end of the shaft 18 is connected rotatably with the sleeve 42. The upper portion of the sleeve 42 immediately below the chuck 44 also has a pulley 46 fixed thereto and around which a driving belt 48 extends. The belt 48 extends around all of the pulleys respectively mounted upon the bearing blocks 34 in the manner shown in FIG. 1 and in which it will be seen that the belt extends around a plurality of idler pulleys 50 as well as the drive pulley 52 on the motor 29, some of the idler pulleys 50 being for purposes of arranging for the desired direction of rotation of the pulleys 46 and details of this feature are described to a better extent in said applicant's prior patent referred to above.

As explained in the foregoing description, the present invention is concerned with two principle features, one of these being mechanism which permits the roll breaking units 32 to be moved between the operative position thereof shown in phantom in FIG. 3 and the inoperative position thereof illustrated in full lines in said figure, and the second feature being adjustment means by which the bearing blocks 34, including the disc knives 16 carried thereby and the roll breaking units 32 also carried thereby, are adjusted transversely with respect to the longitudinal axis of the machine by sliding the rectangular horizontal portions 36 of the bearing blocks 34 axially upon the support and guide rods 22 shown in FIGS. 3 and 4, such movement being of a micromatic nature and each unit may individually be adjusted conveniently and safely either while the machine is idle or even when the same is operating, particularly if it is found that the slicing position of the knives 16 is improper or should be improved with respect to a specific slicing operation for a particular type or shape of roll and correction of such position is necessary. Details of the first of these features are set forth immediately below and details of the second feature are subsequently set forth in the specification.

POSITIONING MEANS FOR ROLL BREAKING UNITS

Referring particularly to FIG. 3, it will be seen that an elongated member 54 extends forwardly from one side of the forward vertical bearing portion 38 of each bearing block 34. The rearward end of member 54 is connected by bolts 56 to said one side of portion 38 of bearing block 34 and, intermediately of the end of member 54, it supports a short shaft 58 which extends perpendicularly thereto for purposes of being received within a bearing 60 fixed to the lower portion of each roll breaking unit 32. Each of said units also include a supplemental bearing block 62. The bearing 60 is the means by which the roll breaking unit 32 is movably connected to each bearing block 34 for movement of the rotatable shafts 30 which are mounted in said supplemental bearing blocks 62 between the operative position shown in phantom in FIG. 3 and the inoperative position shown in full lines in said figure. The lower ends 64 of the rotatable shafts 30 are blade-like. Each roll breaking unit 32 comprises a pair of the shafts 30 and said shafts are disposed within the supplemental bearing blocks 62 at an acute angle to each other for purposes of disposing the lower ends 64 in close proximity for purposes of effecting the breaking of the upper portions of the rolls incident to the same being sliced for purposes of providing a passage for the lower portion of the shafts 18 of the disc knife 16 between adjacent rolls without damaging the same.

The rotatable shafts 30 are driven in opposite directions to enable the blade-like lower ends 64 thereof effectively to break apart the upper portions of the rolls while being sliced, as described above. For purposes of driving said shafts in opposite rotary directions, the lower portion of one of said shafts is provided with a frusto-conical member 66 and the opposite shaft 30 is provided with a complementary frustoconical member 68 upon which a plurality of friction members comprising O-rings are mounted for frictional engagement with the frusto-conical member 66, thereby to effect driving relationship between the shafts 30. The shaft 30 which supports the frusto-conical member 66 also has a circular driven member 72 on the upper end thereof which is fixed to said shaft and said member is frictionally engageable with a circular driving member 74 which is mounted upon and fixed to the sleeve 42 immediately below the pulley 46 as best shown in FIG. 3. Preferably, the driving member 74 is provided with a circumferential frictional band 76, such as a strip of rubber or the like and thereby insuring frictional driving engagement with the driven member 72 on said aforementioned shaft 30 when the roll breaking unit 32 is in the operative position thereof as shown in phantom in FIG. 3. It will thus be seen that simultaneous rotation of the shafts 30 and the lower ends 64 thereof is assured by the driving means described immediately above.

The roll breaking units 32 are maintained in operative position by yieldable means preferably in the form of a tension spring 78 which also is shown in FIGS. 3 and 4. Extending upward from the outer end of member 54 and rigidly fixed thereto is an upright member 80 and the upper end thereof engages the upper end of spring 78, while the lower end of said spring is connected to the outer end of a forwardly extending pin or arm 82 which is fixed to the lower portion of each roll breaking unit 32 adjacent the bearing 60 thereof. Due to the length of the pin 82, as viewed in FIG. 3, it will be seen that the spring 70 is capable of exerting substantial torque upon the roll breaking unit 32 relative to urging the same and maintaining it in the operative position which is illustrated in phantom in FIG. 3 and in which position the driven member 72 is in frictional engagement with the driving member 74.

When it is desired to render the roll breaking units 32 inoperative, which is the condition illustrated in full lines in FIG. 3, this is accomplished by engaging a manually operable lever 84 which is pivotally connected at one end to the upper, forward portion of each roll breaking unit 32 by means of a headed bolt 86 or other suitable member. The opposite end of each lever 84 terminates in a hook-like end 88 and the length of the lever 84 upon each of the combination roll slicing and roll breaking units is sufficient that the hook-like ends 88 thereon extend forwardly a limited distance from the forward end of the cutter head frame 12, as can be seen from FIG. 1, whereby the lever 84 may be manipulated safely and effectively. By pulling upon the hook-like ends 88 in a forward direction, the roll breaking units 32 are moved to the inoperative, full line position shown in FIG. 3 and to maintain the same in said position, it will be seen that each of the levers 84 are provided in limited spaced relationship to the pivoted ends thereof with a notch 90 which receives a positioning pin 92 which is fixedly connected to and supported by the upright member 80. Simply by raising the hook-like end 88 of lever 84 so as to disengage the notch 90 from the pin 92, the spring 78 will immediately pivotally move the roll breaking units 32 to the operative positions thereof and maintain them is such position.

POSITION ADJUSTING MEANS FOR ROLL SLICING AND BREAKING UNITS

Figure 6:
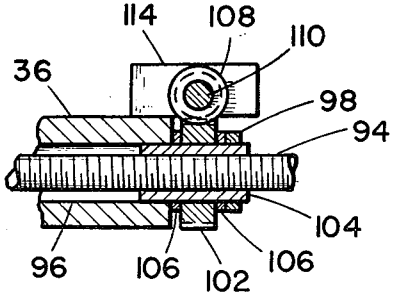
FIG. 6 is another fragmentary vertical sectional view showing details of the mechanism as seen on the line 6—6 of FIG. 4.
Figure 5:
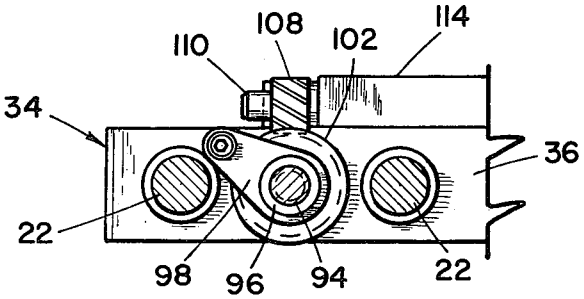
FIG. 5 is a fragmentary vertical elevation illustrating portions of the structure to effect adjustable positioning of the units shown in FIGS. 3 and 4 upon the support and guide rods of the cutter head frame, said view being taken on the line 5—5 of FIG. 4.

For purposes of effecting lateral positioning of the bearing blocks 34 and the roll slicing and breaking mechanism carried by each of said bearing blocks so as to dispose the slicing knives 16 relative to each in positions to effectively slice clusters of rolls of a range of different sizes and shapes by incising the rolls of each cluster from one side inwardly toward the longitudinal joint between adjacent rolls in said clusters, the present invention is provided with effective and precise mechanism to accomplish such adjustable positioning of said units. Said adjustment means comprises a threaded rod 94 which extends through a bore 96 disposed transversely in each of the rectangular horizontal portions 36 of the bearing blocks 34 as best shown in FIGS. 3 and 4. Secured to each of the portions 36 of said bearing blocks 34 in spaced relationship to one side surface thereof is a wing member 98 which is fixed to the outer end of a stud 100 which also is connected to the same surface of portion 36 of the bearing block 34 to provide a space therebetween which positions a worm gear 102 operatively within said space within which it may rotate relative to which it may not move in an axial direction as can be visualized particularly from FIG. 6. The worm gear 102 is fixed to a threaded sleeve 104 which is internally threaded in complementary manner to the threaded rod 94, whereby when the worm gear 102 is rotated, it moves in an axial direction upon the rod 94 and in doing so, carrys its bearing block 34 therewith and slides the same upon the support and guide rods 22 respectively in opposite directions, depending upon the direction of rotation of the worm gear 102. For purposes of accurately positioning the worm gear 102 against axial movement relative to the bearing blocks 34, the worm gear may be provided either with face members on opposite surfaces thereof or appropriate spacing washers 106 may be disposed against the opposite surfaces thereof and thus accurately position the worm gear 102 between the outer wall of portion 36 of each bearing block 34 and the parallel face of wing member 98 associated therewith.

In accordance with the present invention, the worm gears 102 of the bearing blocks 34 are rotated selectively in opposite direction by a worm 108 which is fixed to one end of an actuating shaft 110 which is of appreciable length as can be seen from FIG. 4. Said shaft is supported adjacent opposite ends thereof by opposite end portions of an elongated bracket arm 112 which, at opposite ends thereof, is provided with lateral extensions 114 and 116, both of which extensions are provided with appropriate bearings respectively for the opposite end portions of the shaft 110. The bearing provided in extension 116 preferably is of a split nature and the outer ends 118 may be clamped in locking manner to prevent rotation of shaft 110, such locking being effected by a manually operable screw member 120. The lateral extension 114 is fixedly secured to the upper surface of horizontal portion 36 of the bearing block 34 by means of a plurality of appropriate screws 122.

The outer end of each shaft 110 is provided with a manually engageable actuating member 124 which appropriately may comprise a hand wheel. Due to the length of the shafts 110 and the elongated bracket arms 112, it will be seen that the actuating members 124 are disposed outwardly from the forward end of the cutter head frame 12, whereby the members 24 are available for actuation in a safe manner with respect to the slicing knives 16 and may be operated to effect adjusted lateral positions of the disc knives 16, in either desired direction, individually and either while the machine is operating or idle.

From the foregoing, it will be seen that the present invention provides effective and mechanically durable mechanism for achieving the principal objectives of the invention, namely, moving the roll breaking units associated with each roll slicing disc knife toward and from operative positions with respect to each knife, individually and selectively and maintaining said roll breaking units in either desired positions, as well as the objective of accurately and positively adjustably positioning the bearing blocks which support the roll slicing knives and roll breaking units in opposite axial directions upon the support and guide rods on the cutter head frame of the machine, such adjustment being made manually and individually, in either desired direction, and while the machine is operating or idle, and both of said objectives are achieved from a safe position for the operator relative to the knives of the machine.

The foregoing description illustrates preferred embodiments of the invention. However, the concepts employed may, based upon such description, be employed in other embodiments without departing from the scope of the invention. Accordingly, the following claims are intended to protect the invention broadly, as well as in the specific forms shown herein.

I claim:

1. A machine for slicing rolls between the tops and bottoms thereof while arranged in clusters of a predetermined number of separably adjoined rolls by cutting into one side of the rolls in such clusters along but spaced from a longitudinal joint between adjacent rolls in said clusters, said machine comprising:

a. a cutter head frame having side members and a plurality of parallel guide rods extending horizontally between said side members to comprise a rigid frame, b. a conveyor beneath said guide rods and parallel thereto and supported for movement in a direction to support and feed clusters of rolls in a feeding direction parallel to said side members and transverse to said rods, c. a plurality of bearing blocks supported upon said rods and respectively and rotatably supporting spindle shafts extending perpendicularly above said conveyor and provided with circular disc knives on the ends thereof nearest said conveyor, d. power means operable to rotate said spindle shafts and knives simultaneously to slice rolls in clusters as the same are moved past said knives by said conveyor, in combination with:

e. adjusting means respectively engageable said bearing blocks and operable to move said blocks and knives supported thereby along said guide rods to position said knives at desired spaces from each other within the planes of said knives to effect slicing of rolls in clusters of different sizes and shapes to desired depths relative to said longitudinal joints between adjacent rolls in said clusters, said adjusting means comprising a threaded rod parallel to said guide rods and supported stationarily relative to said side members, and rotatable members respectively mounted upon said bearing blocks and internally threaded complementarily to said threaded rod and mounted thereon for rotation in opposite directions respectively to move said bearing blocks adjustably and longitudinally upon said guide rods.

2. The machine according to claim 1 in which said rotatable members are supported by said bearing blocks by means preventing transverse movement of said members relative to said bearing blocks.

3. The machine according to claim 2 in which said rotatable members comprise worm gears and said adjusting means further including worms respectively supported by said bearing blocks rotatably and engaging said worm gears for actuation thereof when said worms are rotated.

4. The machine according to claim 3 further including actuating shafts rotatably supported by said bearing blocks and connected at one end respectively to said worms and said actuating shafts having manually engageable means on the opposite ends thereof conveniently accessible upon said frame for actuation by an operator when said machine is idle or operating.

5. A machine for slicing rolls between the tops and bottoms thereof while arranged in clusters of a predetermined number of separably adjoined rolls by cutting into one side of the rolls in such clusters along but spaced from a longitudinal joint between adjacent rolls in said clusters, said machine comprising:

a. a machine frame adapted to be supported horizontally and including rotatable means adjacent opposite ends thereof around which an endless flexible horizontal conveyor extends to support clusters of rolls upon the upper span of said conveyor, b. power means operable to drive said conveyor in a direction to move the upper span thereof from a loading end to a discharge end, c. a cutter head assembly supported by said machine frame above said conveyor and substantially coextensive in width therewith, said assembly comprising in combination, d. a cutter head frame having side members between which a plurality of parallel guide rods are fixed to extend in parallelism to said conveyor, e. a plurality of bearing blocks mounted upon said guide rods in adjustable longitudinally spaced relationship to each other, each bearing block having a bearing extending perpendicularly to the plane of said conveyor, f. a spindle shaft rotatably mounted in each bearing and supporting a disc knife on the end nearest said conveyor, g. power means operable to drive said spindle shafts and knives in unison to slice rolls in clusters inward from one side edge of each roll, in combination with:

h. adjustment means connected to each bearing block and operable to move the same adjustably upon said guide rods in opposite longitudinal directions to space said knives in desired positions for slicing rolls according to the sizes and shapes thereof, said adjustment means comprising a threaded shaft extending stationarily between the side members of said cutter head frame and a worm gear rotatably carried by each bearing block and threaded upon said threaded shaft, means on each bearing block preventing axial movement of said worm gear relative to said block, a worm carried rotatably by each bearing block and meshing with said worm gear on said block, and each bearing block having an actuating shaft connected at one end to the worm on said block and the opposite ends of each of said shafts extending forwardly from said cutter head frame toward the loading end of said conveyor, and i. individual actuating means for each adjustment means interconnected thereto and including manually engageable means for each actuating means extending commonly from said cutter head frame for convenient manual engagement and actuation while said machine is operating or idle.

6. The machine according to claim 5 in which each bearing block also supports roll breaking means supported forwardly of said spindle shafts for said knives and in feeding alignment with said shafts above said knives thereof and operable to break apart pairs of rolls along the joints therebetween above the slice made in each roll by said knives to provide a clearance for passage of said spindle shafts between said pairs of rolls, whereby said roll breaking means are adjustable simultaneously with said knives when said bearing blocks are adjusted.

7. A machine for slicing rolls between the tops and bottoms thereof while arranged in clusters of a predetermined number of separably adjoined rolls by cutting into one side of the rolls in such clusters along but spaced from a longitudinal joint between adjacent rolls in said clusters, said machine comprising:

a. a cutter head frame having side members and a plurality of parallel guide rods extending horizontally between said side members to comprise a rigid frame, b. a conveyor beneath said guide rods and parallel thereto and supported for movement in a direction to support and feed clusters of rolls in a feeding direction parallel to said side members and transverse to said rods, c. a plurality of bearing blocks supported upon said rods and respectively and rotatably supporting spindle shafts extending perpendicularly above said conveyor and provided with circular disc knives on the ends thereof nearest said conveyor, d. power means operable to rotate said spindle shafts and knives simultaneously to slice rolls in clusters as the same are moved past said knives by said conveyor, e. an elongated arm connected to and projecting forwardly from each of said bearing blocks and provided with a supporting shaft, roll breaking units pivotally supported respectively by said elongated arms upon said supporting shafts thereon forwardly of said spindle shafts in said bearing blocks relative to the direction of feed of said rolls by said conveyor, said breaking units being in longitudinal alignment with said spindle shafts for said knives and mounted for operation immediately above the plane in which said knives rotate and operable to break apart pairs of rolls along the joints therebetween above the slice made in each roll by said knives to provide a clearance for passage of said spindle shafts of said knives between said pairs of rolls incident to said rolls being sliced from end to end, and f. roll breaking units each comprising a pair of rotatable shafts mounted within bearings in supplemental blocks supported upon said supporting shafts in said elongated arms, means normally urging said supplemental blocks and rotatable shafts of said units toward said operative positions thereof relative to said knives, and tension spring means connected to said supplemental blocks of said units and operable to move the same toward the inoperative positions and hold the same in said inoperative positions.

8. The machine according to claim 7 in which said rotatable shafts of said roll breaking units have blade-like ends which are engageable with said rolls to break portions thereof apart, said roll breaking units further including coengaging members fixed to said pairs of rotatable shafts and operable so that when one shaft is driven in one direction the other shaft is rotated in the opposite rotary direction to cause said blade-like ends to rotate in similar opposite directions selected relative to the path of movement of the clusters of rolls to effect a breaking apart of adjacent rolls, and said power means of said machine further including pulleys upon the upper ends of said knife spindle shafts and an endless belt extending around said pulleys and a drive pulley on an electric motor supported upon said cutter head frame, a rotatable circular drive member fixed to each knife spindle shaft adjacent said pulley on each shaft, and a driven rotatable circular member on one of the rotatable shafts of said roll breaking units mounted for frictional driving engagement with said rotatable circular drive member when said roll breaking units are in the operative positions thereof to cause said pair of rotatable shafts to break apart said rolls as aforesaid, one of said rotatable circular members having friction means thereon to facilitate driving relationship therebetween.

9. The machine according to claim 7 in which each bearing block for said knife spindle shafts has an arm projecting therefrom and said means normally urging said supplemental block toward said operative positions comprising a spring extending between said supplemental blocks and said arms on said bearing blocks.

10. The machine according to claim 8 in which said means to move said supplemental blocks toward the inoperative positions thereof and hold the same in said positions comprise a manually engageable lever connected to each supplemental block and operable to move the same for the operative position thereof against the force of said spring, and means engageable with said lever to retain the same releasably in said latter position until the roll breaking units are to be restored to operative positions.

11. The machine according to claim 10 in which said manually engageable levers each have a notch therein and said bearing blocks have pin means positioned to be reclined in said notches in said levers when said supplemental blocks are in the inoperative positions thereof to retain them in said positions.

12. The machine according to claim 11 in which said manually engageable levers extend forwardly from said roll breaking units toward the loading end of said conveyor for convenient access, said levers terminating in the forward ends thereof with a hook-like configuration for ready manual engagement and operation of said levers.

* * * * *